United States Patent [19]

Bingham et al.

[11] Patent Number: 4,932,650

[45] Date of Patent: Jun. 12, 1990

[54] SEMI-RECUMBENT EXERCISE CYCLE

[75] Inventors: Curt G. Bingham; William T. Dalebout, both of Logan, Utah

[73] Assignee: Proform Fitness Products, Inc., Logan, Utah

[21] Appl. No.: 297,076

[22] Filed: Jan. 13, 1989

[51] Int. Cl.[5] ..... A63B 69/16

[52] U.S. Cl. ..... 272/73; 272/130

[58] Field of Search ..... 272/72, 73, 130, 128; 128/25 R

[56] References Cited

U.S. PATENT DOCUMENTS

| | | | |
|---|---|---|---|
| D. 218,107 | 7/1970 | Feather | 272/73 |
| 4,084,810 | 4/1978 | Forshon | 272/73 |
| 4,537,396 | 8/1985 | Hooper | 272/73 |
| 4,589,656 | 5/1986 | Baldwin | 272/73 |
| 4,743,011 | 5/1988 | Coffey | 272/72 |

FOREIGN PATENT DOCUMENTS

| | | | |
|---|---|---|---|
| 0203804 | 12/1986 | European Pat. Off. | 272/73 |

*Primary Examiner*—Stephen R. Crow

*Attorney, Agent, or Firm*—Trask, Britt & Rossa

[57] ABSTRACT

An exercise cycle having a frame, a pedal actuated gear arrangement and an impeller, mechanically associated with that gearing arrangement, is disclosed. The impeller is housed within a chamber defined within a housing mounted on the frame. The chamber includes an inlet opening for introducing a stream of environmental air into the chamber and an outlet opening adapted for directing a flow of pressurized air generated by the impeller's rotation over the body of the user.

16 Claims, 5 Drawing Sheets

SEMI-RECUMBENT EXERCISE CYCLE

BACKGROUND OF THE INVENTION

1. Field

This invention is directed to exercise equipment. More particularly, the invention relates to equipment designed to simulate the exercise of bicycling.

2. State of the Art

Popular interest in physical fitness has contributed to a demand for equipment adapted for performing physical exercises. Presently, there exists a considerable demand for equipment which is usable indoors to simulate exercising activities which traditionally are considered outdoor activities. This equipment permits the user to exercise year round, independent of outdoor weather conditions. Furthermore, many types of such equipment are now being manufactured for use in the operator's home.

One of the more popular forms of exercise is that of bicycling. While summertime conditions permit a cyclist to enjoy this activity to the fullest, winter conditions are often ill-suited for cycling. For example, not only do streets become slick due to rain and ice, causing considerable potential dangers for a cyclist, but further, the temperature becomes very cold, thereby rendering any cycling activity, due to wind chill, less than an enjoyable activity.

For many years, cycling enthusiasts, and individuals interested in fitness generally, have relied on a stationary cycle-like apparatus to simulate bicycling. These apparati have contributed to a maintenance of fitness and muscle tone when weather conditions were not conducive to cycling out of doors. Many configurations for such apparatus have been suggested in the art. Among these configurations are those described in the following U.S. Patents: U.S. Pat. No. 4,657,244 (Ross); U.S. Pat. No. 4,586,706 (Chen); U.S. Pat. No. 4,188,030 (Hooper); U.S. Pat. No. 4,082,264 (Santos); U.S. Pat. No. 3,979,113 (Uhl et. al.); U.S. Pat. No. 3,940,128 (Rajone); U.S. Pat. No. 3,758,111 (Agamian); U.S. Pat. No. 3,751,033 (Rosenthal); U.S. Pat. No. 3,112,188 (Hanke); U.S. Pat. No. 2,872,191 (Gallo); U.S. Pat. No. 2,565,348 (Brockman); U.S. Pat. No. 7,453,771 (White et. al.); U.S. Pat. No. 2,261,355 (Flynn); and U.S. Pat. No. 326,247 (Root):

SUMMARY OF THE INVENTION

An exercise cycle having an air driving on pump means associated therewith adapted for providing a stream of cooling air over the body of the user during the cycle's operation is disclosed. The cycle further provides a novel support assembly suited for ease in transporting the cycle from one location to another.

The cycle includes a generally elongate frame means having a rotatably mounted wheel means mounted proximate an end thereof. The frame means further includes one or more support members mounted thereto to extend laterally outward in a ground engaging orientation. The supports form at once means of stabilizing the frame means and retaining that frame means in an upright orientation while furthermore providing hand graspable handles for raising the cycle and concentrating its weight over and atop the wheel means. With the weight so concentrated the wheel arrangement enables the cycle to be transported from location to location in a manner analogous to that utilized for a wheel barrow.

The cycle frame means is fitted with a rotatably mounted shaft means fitted with pedals suited for engaging an operators feet. The shaft means is connected to a vane-fitted impeller by a drive means which may include a series of intercooperating gears and/or pulleys. The impeller is mounted within a chamber defined by a housing mounted on the frame means. The impeller is rotatably mounted on the frame means.

The housing defines an inlet means which communicates the chamber with the environment thereby providing a means for a supply of environmental air to enter the chamber. The housing also defines an outlet means communicating with the chamber whereby pressurized air may be discharged from the chamber. The outlet means is positioned proximate a seating means mounted on the frame means whereby, a stream of air exiting the outlet means is directed over the body of a user seated on the seating means. The provision of the outlet air stream is adapted to provide a refreshing and invigorating benefit for the energies expended by the operator during his exercise session. The impeller also provides a resistant or drag force to the foot pedal induced rotation of the shaft. Resultingly, the impeller provides a means of providing a level of exercise difficulty to the cycle's operation while simultaneously providing an invigorating flow of cooling air over the operator's body during the operation of the cycle.

DETAILED DESCRIPTION OF THE DRAWINGS

Figure 1:
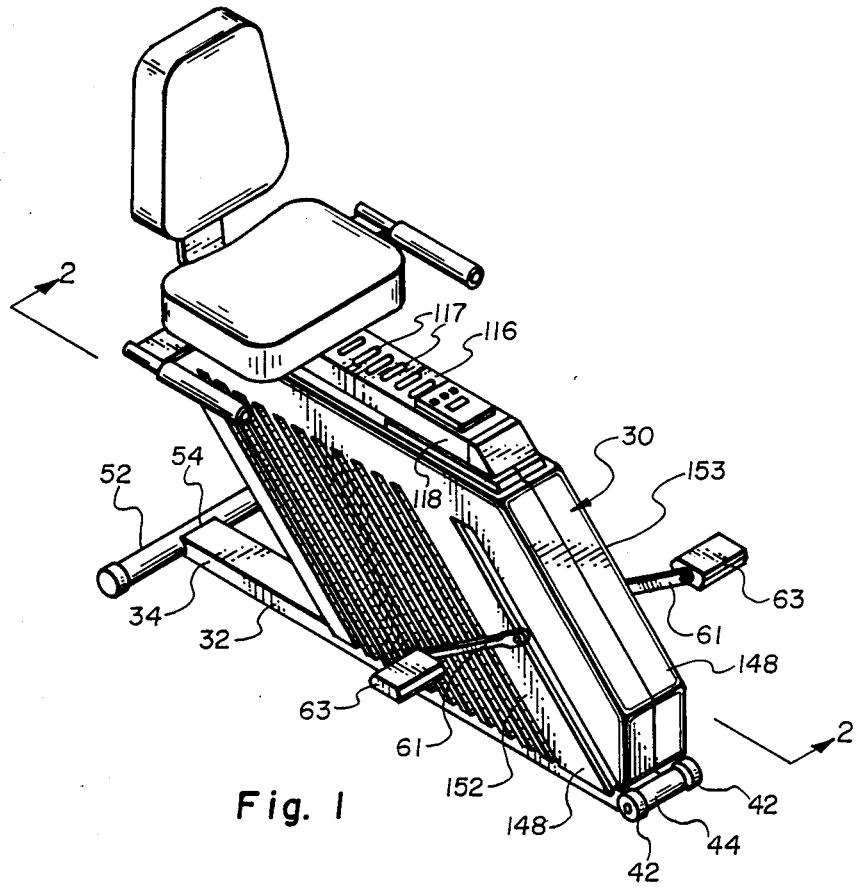
FIG. 1 is an elevational perspective view of an exercise cycle of the invention.

An exercise cycle 30 of the instant invention is shown generally in FIG. 1. The cycle 30, of a type known generally as a semi-recumbent exercise cycle, includes a frame 32 having an elongate, linear base frame member 34 with a plurality of upright extensions 36 mounted thereon. The extensions 36 are each fixedly mounted to an elongate, linear upper frame member 38.

Figure 6:
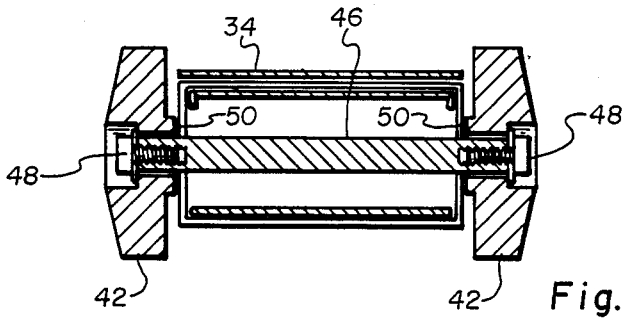
FIG. 6 is a cross-sectional view of the front wheel assembly of the exercise cycle frame.
Figure 7:
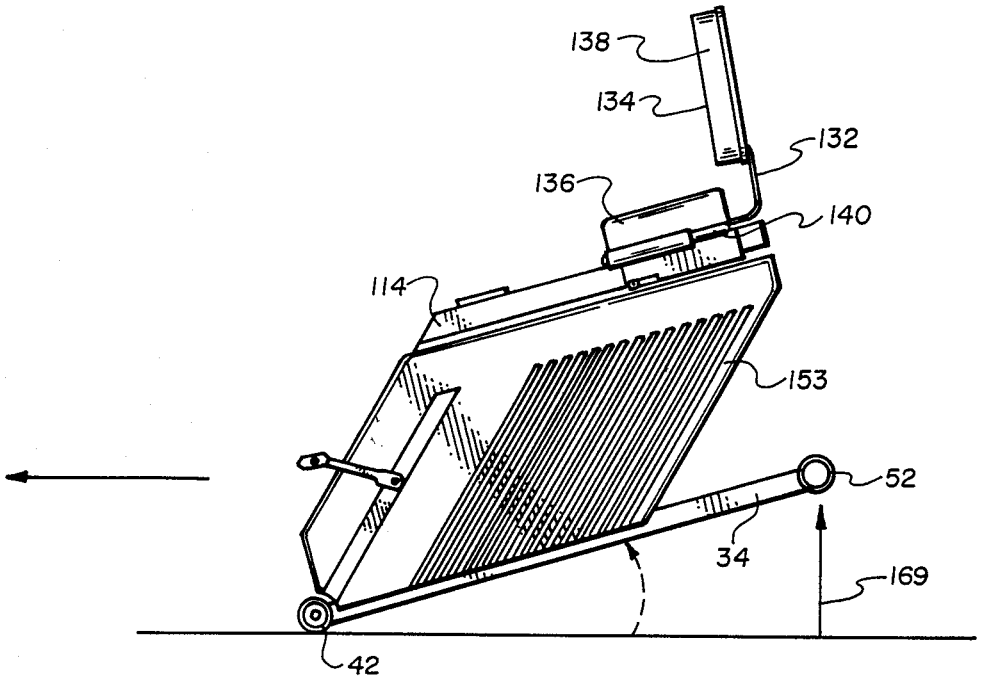
FIG. 7 is an elevational left side view of the exercise cycle of FIG. 1.
Figure 8:
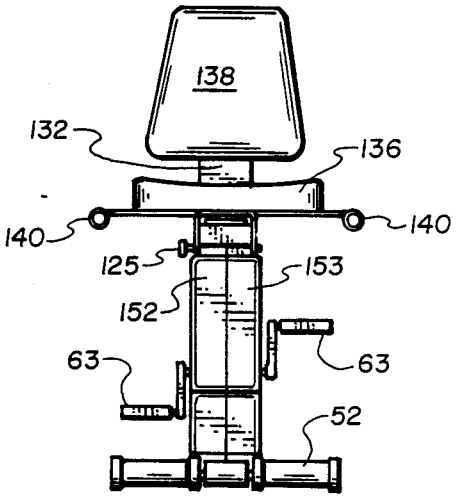
FIG. 8 is a front elevational view of the exercise cycle illustrating the relative positioning of the front wheel with the two laterally extending supports.
Figure 9:
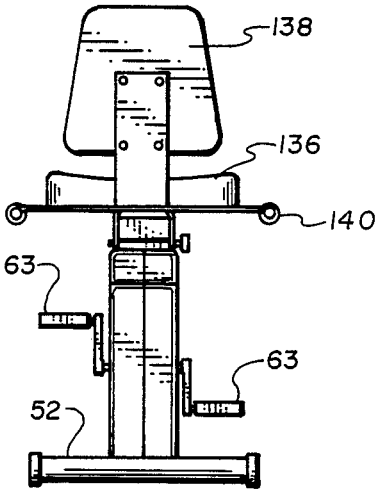
FIG. 9 is a rear elevational view of the cycle.

Base frame member 34 is a quadrilaterally crosssectioned, hollow member (FIG. 6) having a longitudinal axis 40 associated therewith. A pair of circular wheels 42 are rotatably mounted to a first end 44 of the frame member 34 by means of an axle 46 which is journaled through frame member 34. Axle 46 is journaled through the two spacedly positioned wheels 42. As shown in FIG. 6, the wheels 42 are each held in association with axle 46 by means of a respective lock bolt 48 which is threadedly inserted into one of the opposing ends of axle 46. Each bolt 48 includes a flange thereon which dimensionally exceeds the journaled aperture in its respective wheel 42, and thereby retains the wheel 42 between the sidewall 50 of base member 34 and the flange of bolt 48.

A laterally extending support 52 is mounted in the opposing second end 54 of member 34. As shown, support 52 is a tubular, cylindrically shaped member having end caps 56 affixed on each of its ends.

The association of the wheels 42, support 52 and frame member 34 provides a structure which may be lifted on its second end 54 and rolled about on its first end 44 wheel 42. This particular arrangement is contrasted to the prior art devices which typically include non-wheel fitted support structure. Noticeably, the new cycle is relatively easy to move from one location to another, e.g., for storage or other purposes, and in principle operates similarly to a wheel barrow.

The supports 52 function to stabilize the cycle 30 in an upright orientation.

An extension 36, generally denjuated 60 is angularly mounted to base member 34. An elongate cylindrical shaft 59 is journaled into the extension 60 and extends outward therefrom. A circular gear 62 having teeth configured on its perimeter is fixedly mounted to shaft 59, proximate the midpoint of that shaft length. The shaft 59 is preferably mounted within bearings secured within the extensions 60.

Shaft 59 is mounted on each of its opposing ends with an orthogonally oriented extension 61. A laterally extending pedal 63 is mounted on each extension 61.

A pair of extensions 36, generally designated 64 is angularly mounted to the base member 34 and positioned spacedly apart one another. Mounted on each of the extensions 64 is an auxiliary extension 66 which extends outwardly and includes a slot 68 therein.

Each slot 68 receives one end of an elongate cylindrical axle 70. The axle 70 is secured in place within each of the slots 68 by a pair of bolts 72. Each respective bolt 72 has an eyelet formed end which receives the axle 70 therethrough and a male threaded end which threadedly receives a nut 74. The bolt 72 passes through a slot in an upstanding bracket 76 mounted on extension 66. The orientation and location of the axle 70 is made adjustable by the adjustment of the location of nut 74 on the shaft of bolt 72.

Axle 70 is journaled at each of its respective ends into one of a pair of support bearings 78. Bearings 78 in turn are mounted with an elongate cylindrical sleeve 80 which sleeve includes a toothed gear 82 fixedly mounted thereon proximate its first end and a circular pulley member 84 mounted fixedly proximate its second end.

Gear 62 is mechanically linked to gear 82 by means of a linked chain 86 which is trained over both of the gears to form an endless continuous member.

Pulley 84 defines a recessed track about its circumference dimensioned to receive an endless pulley belt 88 which is trained over that pulley.

Figure 2:
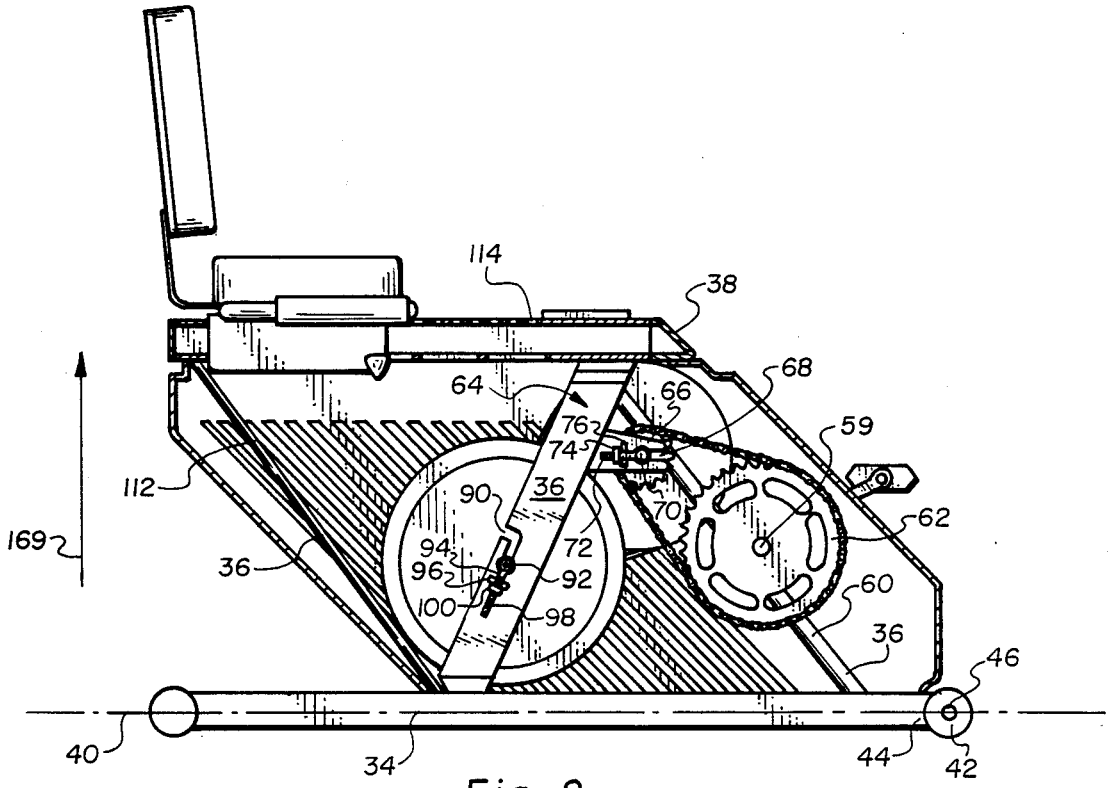
FIG. 2 is a side view of the exercise cycle of FIG. 1 wherein the right side of the housing has been removed to reveal the cycle's drive mechanism.
Figure 3:
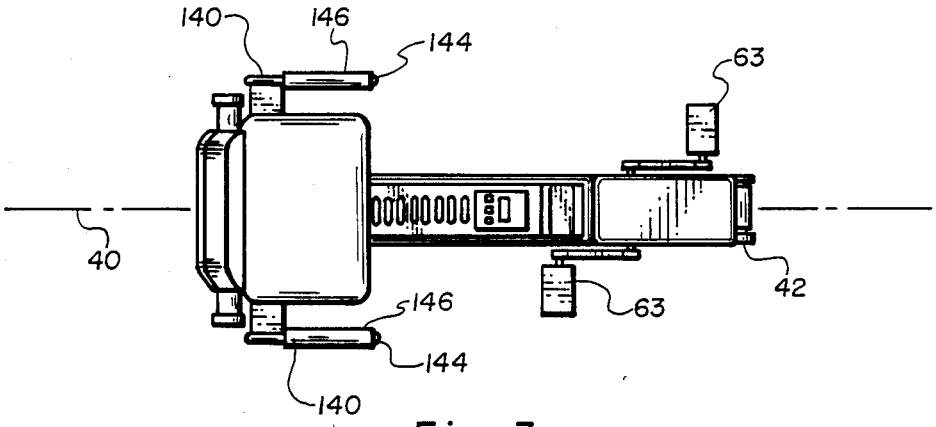
FIG. 3 is a top view of the exercise cycle illustrating the relative positioning of the seat and the air diffusion vent.
Figure 4:
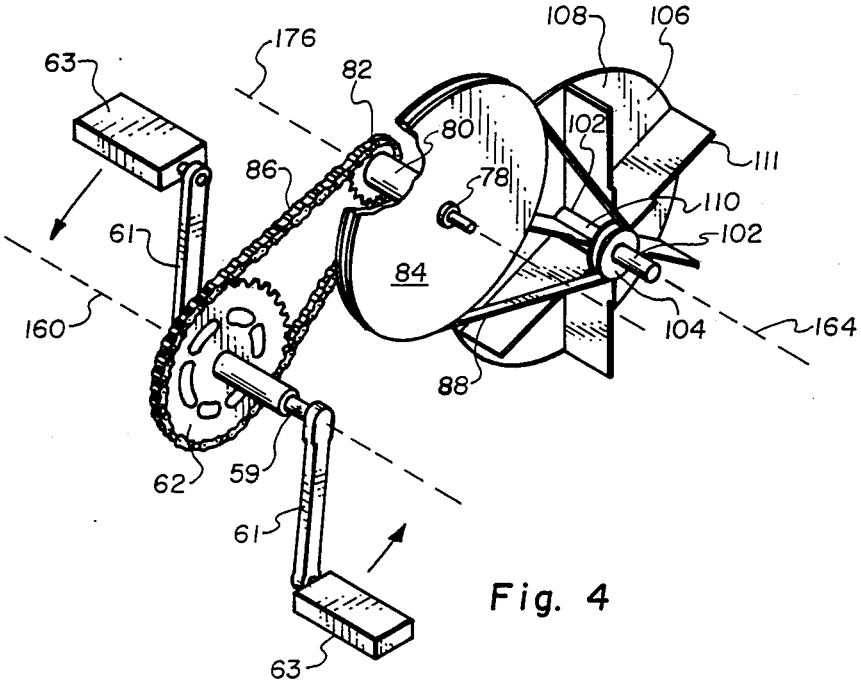
FIG. 4 is an elevational perspective view of the pedal driven impeller of the cycle.
Figure 5:
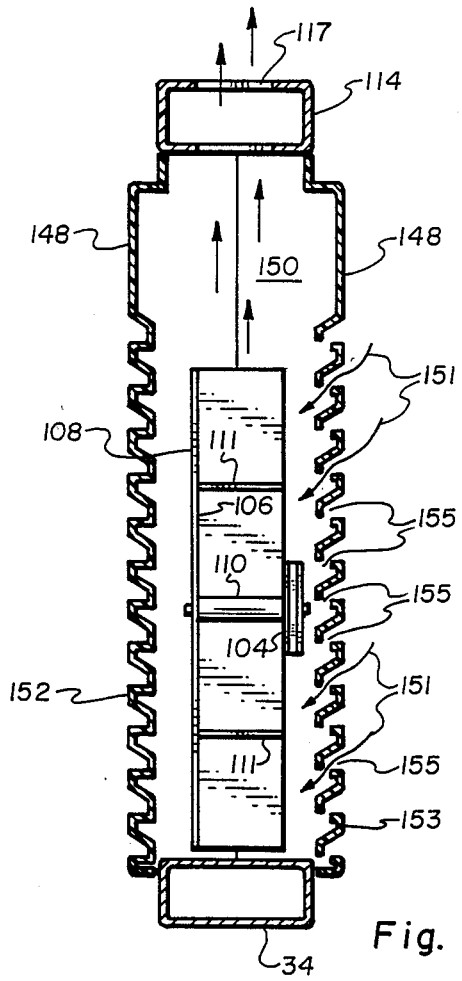
FIG. 5 is a cross-sectional view of the cycle of FIG. 1 taken along section lines 5—5.

Each extension 64 defines an inverted "L"-shaped slot 90 therein dimensioned to slidably receive an end of an elongate cylindrical axle 92. The axle 92 extends between the extensions 64 through the respective slots 90, and outwardly from each of the extensions 64 sufficiently to cooperate with a respective retention apparatus 94 mounted on each extension 64. As shown in FIG. 2, a retention apparatus 94 includes an upstanding slot defining bracket 96 mounted on extension 64 and an elongate eyelet defining bolt 98 which receives an end of axle 92 through its eyelet. Bolt 98 includes a plurality of male threads which threadedly receive a nut 100. Bolt 98 extends from its mounting with axle 92 through the slot in bracket 96 and outwardly therefrom. The nut 100, upon being threaded onto the bolt 98, abuts against bracket 96, thereby retaining the axle 92 in a desired location and orientation against the action of belt 88. Understandably, the location of the axle 92 can be modified by rearranging the location of the nut 100 on bolt 98.

Axle 92 is journaled through bearings 102 mounted within a circular pulley 104 and an impeller 106.

Pulley 104 defines an annular recessed track about its circumference dimensioned to receive endless belt 88.

Impeller 106 includes a planar circular base 108, a hollow cylindrical sleeve 110 mounted upstanding on that base 108 and a plurality of planar vanes 111 mounted to extend laterally from the sleeve 110 and upstandingly from base 108. As shown, vanes 110 are symmetrically arranged about sleeve 110 and each vane defines a generally elongate, linear notch therein. The pulley 104 is fixedly mounted to sleeve 110 whereby any angular rotation of that pulley 104 causes a corresponding rotation of impeller 106.

A third extension 36, generally designated 112 is angularly mounted on base member 34.

An elongate, hollow box-like upper frame 114 is mounted to the free ends of the various upright extension 36 to extend generally parallel to the base member. Upper frame 114 has a planar top surface 116 which defines a plurality of slot-like apertures 117 therein. As shown, each of the apertures 117 extend laterally across the face of the top surface 116. The apertures 117 are arranged side-by-side in a parallel configuration to extend along a substantial length of the top surface 116. The top surface 116 is supported by two parallely positioned, planar sidewalls 118.

An inverted "U"-shaped carriage 120 is mounted over and atop the top surface 116 and is dimensioned to slide along the length of that surface 116, the upper frame 114 in effect forms an elongate linear guide track which is received within the channel 102 defined within the inverted "U"-shaped carriage 120.

Figure 10:
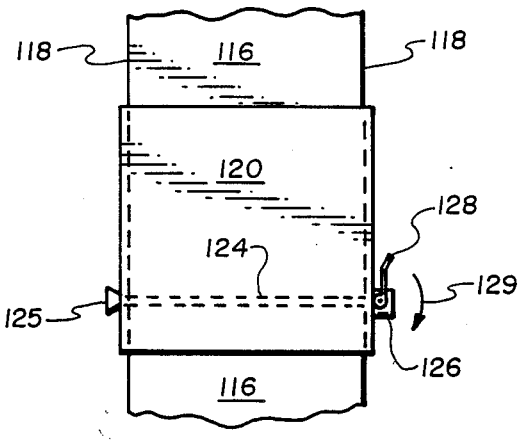
FIG. 10 is a sectional top view of the upper frame assembly of the cycle, the seat having been removed for clarity.
Figure 11:
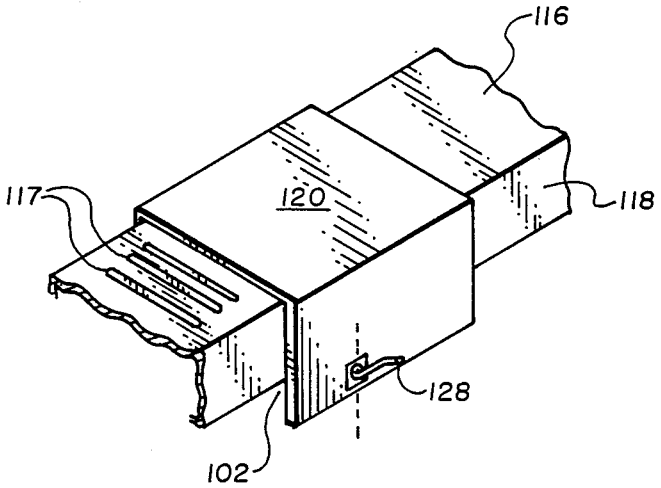
FIG. 11 is a sectional perspective view of the upper frame assembly of FIG. 10.

As shown in FIG. 10, the carriage 120 is a solid walled body. As the carriage is displaced along frame 114 over surface 116, and more specifically over and atop slot apertures 117, the carriage functions to deflect the vertically upward directed air the exiting from those apertures. Whereas the air flow previously passed over the front of a user's body who was seated on seat 136, the carriage deflects the flow away from the user's body. Observably, the user can vary the quantity of air being so deflected by adjusting the position of the carriage 120 vis-a-vis the apertures 117.

The carriage 120 includes a bolt 124 having an enlarged head 125, adapted to be hand graspable, which bolt is journaled through the carriage to extend between the opposing sidewalls 118 thereof. The bolt 124 is fitted in its shaft end with a pivotedly mounted lever 128 having an eccentrically configured cammed end. As shown in FIG. 10, lever 128 includes a lobed end 126 which open the lever being positioned in the orientation shown; the lever exerts a laterally directed force against the proximate carriage sidewall 118 thereby causing the two sidewalls 118 to be drawn together sandwiching the upper frame 114 therebetween in a pressure locked arrangement. To displace the carriage 120 along the upper frame 114 the user pivots the lever 128 in the direction indicated by arrow 129 thereby disengaging the abutment of the lever 128 against the sidewall 118 (the disengagement resulting from the eccentric configuration of the lever.) The carriage 120 is thereafter freed for longitude displacement along the upper frame 114. Upon the carriage 120 being displaced to a desired new location, the lever 128 is again pivoted to bring the lobe of the lever cam 126 into its securing position against sidewall 118.

An upright "L"-shaped bracket 132 is mounted on carriage 120 to form a frame for a seat 134. Two cushions, a lateral cushion 136 and a vertically positioned cushion 138 are fixedly mounted to the bracket 132 to form a seat for the user.

Two "L"shaped members 140 are mounted to carriage on opposite sides thereof to form two hand graspable handles for a user seated on seat 134. As shown each member 140 extends initially laterally from the carriage 120 and thereafter extends parallel the longitudinal axis 142. The longitudinally extending section 144 of each member 140 may be pitted with cushioned handgrips 40.

A housing 148 is configured to define a hollow chamber 150 therein is mounted on frame 32 whereby the impeller 106 is positioned within the chamber 150. In the embodiment shown in FIG. 1–11, the housing 148 is formed of a pair of housing half sections 152 and 153, jointed together along the edges defining the open sides thereof to form an enclosure defining a hollow chamber 150 about impeller 106. As shown in FIG. 6 housing half 153 defines a plurality of slots 155 therein which communicate the environment with the chamber 150 thereby permitting a flow of air 151 from the environment through the housing half 153 and into the vanes of impeller 106. As shown in preferred embodiments, the housing half 153 positioned proximate the open face of the impeller is the housing half defining the inlet opening i.e., slots 155 into the chamber 150. Except for the inlet slots 155 and the outlet slots 117, the housing 148 is substantially sealed, whereby the pressurized air created by the operation of impeller 106 is in a large part driven outward through the discharge slots 117 upon operation of the cycle.

The cycle is operated by a user who positions himself seatingly in a seat cushion 136 and places his feet on pedals 67. The handles 146 provide a means for the user to stabilize himself during the performance of the cycling exercises. By pushing on pedals 63, the user causes an angular rotation of shaft 59 and hence gear 62 about axis 160. The rotation of gear 62 is translated to gear 82 by drive chain 86. Due to the fixed mounting of gear 82 on sleeve 80, the rotation of gear 82 causes a rotation of sleeve 80 and pulley 84 about axis 176. The angular rotation of pulley 84 causes a corresponding rotation of pulley 104 due to drive belt 88. Pulley 104 being fixedly mounted to impeller 106 causes a corresponding rotation of impeller 106 about axis 164.

The angular rotation of impeller 106 within chamber 150 causes a stream of air from the environment to flow through the slots 155 into the chamber 150 to replace that discharged outward through the discharge slots 117.

The dimensions and gear ratios of the various gears and pulleys can be adjusted to yield any of a number of gear ratios.

Air discharged through slots 117 is directed upward over the body of the user seated on seat 34.

When the user desires to transport the cycle 30; the support 52 may be grasped and lifted upwards in the direction indicated by arrow 169, thereby concentrating the weight of the cycle on wheels 42. Therefore, the cycle may be transported by urging the cycle 30 forward similarly to the approach one would use in pushing a wheel barrow.

Though those skilled in the art will recognize that the embodiment herein described is illustrative of the principles of the invention, the embodiment herein described is not intended to limit the scope of the claims, which themselves recite what applicants regard as their invention.

We claim:

1. An exercise cycle comprising:

a frame;

a shaft rotatably mounted on said frame;

a pair of pedals mounted on said shaft;

an impeller rotatably mounted on said frame;

gearing means for mechanically cooperating said shaft with said impeller whereby a rotation of said shaft effects a rotation of said impeller; and a housing mounted on said frame, said housing defining a hollow chamber which encases said impeller, said housing defining an inlet opening communicating said chamber with the environment;

an elongate guide track mounted on said frame, said guide track having a length;

a vent means, mounted within said quick track, which communicates with said hollow chamber for directing a flow of air, generated by a rotation of said impeller;

a carriage mounted on said guide track, said carriage being displaceable along said length of said guide track, said carriage being adjustably disposable over and atop said vent means to deflect a portion of said flow of air exiting said vent means away from said user's body;

said carriage functioning as an adjustable means of controlling the quantity of said air flow over a body of a user positioned on said seat during said cycle's operation;

a seat mounted on said carriage.

2. The exercise cycle of claim 1 wherein said frame includes a rotatable ground-engaging wheel mounted proximate a first end thereof and a laterally extending ground-engaging support mounted on its opposing second end.

3. The exercise cycle of claim 1 wherein said gearing means comprises:

a first, toothed spur gear fixedly mounted on said shaft;

a second toothed gear fixedly mounted to a first axle journaled in said frame;

a drive chain trained over said first and second gears;

a first drive pulley fixedly mounted on said first axle, having an annular track defined about its circumference;

wherein said impeller includes a solid base, a plurality of upstanding vanes mounted thereon to extend outwardly from a center of said base, and a second drive pulley fixedly associated with said base, said drive pulleys being intercooperated by a drive belt.

4. The exercise cycle of claim 3 wherein said impeller is mounted upright, said vanes facing a first upright, perforated side of said housing, said solid base facing a second upright, solid side of said housing, said perforated side of said housing constituting an inlet.

5. The exercise cycle of claim 1 wherein said outlet is positioned above said impeller in a flow path of air circulated by a revolution of said impeller.

6. The exercise cycle of claim 1 wherein said frame includes a seat mounted thereon having a pair of laterally extending graspable handles mounted on opposing sides thereof.

7. The exercise cycle of claim 1 wherein said outlet means is an air diffuser mounted on said housing above said impeller for distributing said air flow over said user.

8. The exercise cycle of claim 1 wherein said impeller includes elongate straight member vanes mounted thereon.

9. The exercise cycle of claim 6 wherein said seat is mounted longitudinally slidable along said frame, wherein said seat is slidable over and atop said outlet means.

10. An exercise cycle comprising:

an elongate frame having a first end and an opposing second end;

a wheel rotatably mounted to said frame on said frame's first end;

a pair of supports mounted on said frame second end to extend laterally therefrom in opposite directions;

a shaft rotatably mounted on said frame;

a pair of pedals mounted on said shaft;

an impeller, rotatably mounted on said frame;

gearing means for mechanically associating said shaft with said impeller whereby a rotation of said shaft effects a rotation of said impeller, thereby creating a flow of air;

a housing method on said frame to define a hollow chamber about said impeller, said housing having an inlet opening which communicates said chamber with the environment;

an elongate guide track mounted on said frame, said guide track having a length;

a vent means mounted within said guide track which communicates with said hollow chamber for directing a flow of air generated by a rotation of said impeller over the frontal portion of a user's body, who is positioned on said frame during said cycle's operation;

a carriage mounted on said guide track for sliding displacement along said guide track's length, said carriage being selectively positionable over and atop said vent means to adjust the quantity of air being directed over said user's body;

a seat mounted on said carriage;

wherein to direct said flow of air outwardly from said housing and over the front of a user positioned on said seat and wherein said quantity of air being directed over said user is adjustable by adjusting the location of said carriage along said guide track;

wherein said exercise cycle may be transported by lifting said supports of said second end and by rolling said cycle along on said wheel mounted on its first end.

11. The exercise cycle of claim 10 wherein said seat includes a pair of spacedly positioned, laterally extending, graspable handles mounted thereon.

12. The exercise cycle of claim 9 wherein a hand graspable portion of each said handle is an elongate member positioned parallel a longitudinal axis of said frame.

13. The exercise cycle of claim 10 wherein said frame includes a rotatable ground-engaging wheel mounted proximate a first end thereof and a laterally extending ground-extending support mounted on its opposing second end.

14. The exercise cycle of claim 10 wherein said gearing means comprises:

a first, toothed spur gear fixedly mounted on said shaft;

a second toothed gear fixedly mounted to a first axle journaled in said frame;

a drive chain trained over said first and second gears;

a first drive pulley fixedly mounted on said first axle, having an annular track defined about its circumference;

wherein said impeller includes a solid base, a plurality of upstanding vanes mounted thereon to extend outwardly from a center of said base, and a second drive pulley fixedly associated with said base, said drive pulleys being intercooperated by a drive belt.

15. The exercise cycle of claim 10 wherein said carriage bracket is detachably connected to said guide track by a connection means.

16. The exercise cycle of claim 15 wherein said connection means comprises:

an elongate shaft mounted on said carriage to extend laterally through a width of said carriage; said shaft having an enlarged head on its first end which abuts against an exterior surface of said carriage;

a lever fitted cam rotatably mounted on a second end of said shaft, said cam being disposable against an exterior surface of said carriage to exert a force against said exterior surface;

wherein said lever being manually actuatable to rotate said cam and thereby induce an inwardly directed force on said bracket through intermediation of said enlarged head and said cam, said carriage being deformable about said guide track whereby said force application creates a pressure connection between said carriage and said guide track.

* * * * *